US006168095B1

(12) United States Patent
Seitter et al.

(10) Patent No.: US 6,168,095 B1
(45) Date of Patent: Jan. 2, 2001

(54) FUEL INJECTOR FOR AN INTERNAL COMBUSTION ENGINE

(75) Inventors: Max Seitter; Friedrich Muehleder, both of Muehlacker (DE)

(73) Assignee: Robert Bosch GmbH, Stuttgart (DE)

( * ) Notice: Under 35 U.S.C. 154(b), the term of this patent shall be extended for 0 days.

(21) Appl. No.: 09/269,667

(22) PCT Filed: Mar. 4, 1998

(86) PCT No.: PCT/DE98/00620

§ 371 Date: May 28, 1999

§ 102(e) Date: May 28, 1999

(87) PCT Pub. No.: WO99/06692

PCT Pub. Date: Feb. 11, 1999

(30) Foreign Application Priority Data

Jul. 31, 1997 (DE) ..... 297 13 628

(51) Int. Cl.[7] ..... F02M 61/00

(52) U.S. Cl. ..... 239/533.3; 239/533.12; 239/DIG. 19

(58) Field of Search ..... 239/533.2, 533.3, 239/533.4, 533.5, 533.8, 533.9, 533.11, 533.12, DIG. 19

(56) References Cited

U.S. PATENT DOCUMENTS 4,801,095 * 1/1989 Banzhaf et al. ..... 239/533.3
5,492,357 * 2/1996 Fukushima et al. ..... 148/326

FOREIGN PATENT DOCUMENTS

4033706 * 2/1991 (DE) .

* cited by examiner

*Primary Examiner*—Andres Kashnikow
*Assistant Examiner*—Robin O. Evans
(74) *Attorney, Agent, or Firm*—Ronald E. Greigg; Edwin E. Greigg

(57) ABSTRACT

A fuel injector for internal combustion engines, with a nozzle body in which a valve needle with a sealing face is movably supported. The sealing face of the valve needle comes into contact with a valve seat face that is adapted to the sealing face and is formed on an inner wall region of an end cup of the nozzle body. At least one injection opening is provided in the valve seat face, wherein both the inner wall region with the valve seat face of the nozzle body disposed on it and an outer wall region are hardened. The nozzle body is comprised of a rustproof martensitic steel that is hardened by means of case hardening with nitrogen.

16 Claims, 1 Drawing Sheet

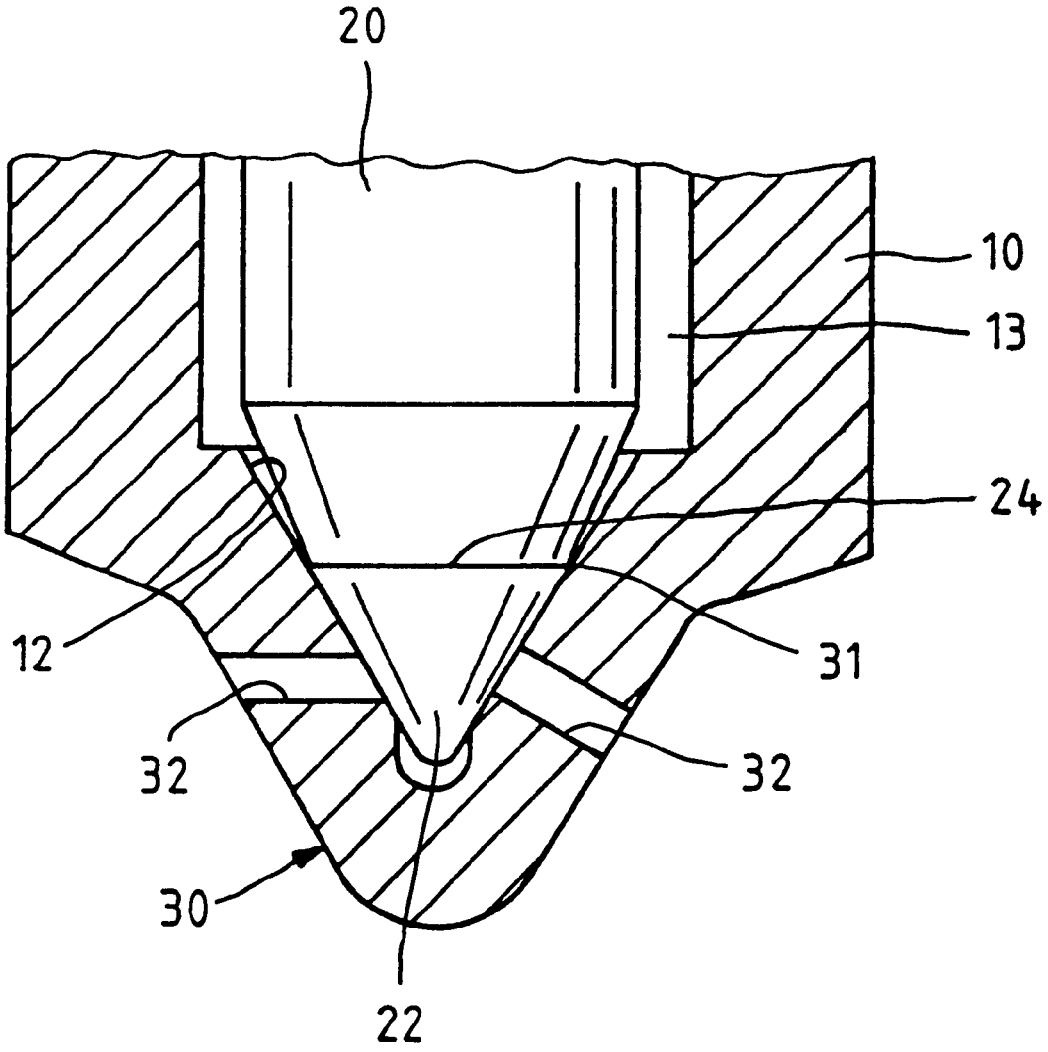
20
10
13
24
12
31
32
32
30
22

FUEL INJECTOR FOR AN INTERNAL COMBUSTION ENGINE

PRIOR ART

The invention relates to a fuel injector for internal combustion engines. A nozzle body includes a valve needle with a sealing face which is movably supported whose needle comes into contact with a sealing face adapted to the needle that is embodied in an inner wall region of an end cup of the nozzle body. At least one injection opening is provided in this sealing face, wherein both the inner wall region, with the sealing face of the nozzle body disposed on it, and its outer wall region are hardened.

This kind of fuel injector for internal combustion engines is drawn, for example, from EP 0 233 190 B1. In that instance, the inner wall region of the end cup provided with the valve seat face, through boundary layer hardening, is provided with a greater hardness than the outer wall region and the central boundary region disposed between the valve seat face and the opposing outer wall region.

The nozzle body of these fuel injectors is comprised of case hardened steel, which is variously carbonized in order to develop the various hardness gradients.

Fuel injectors of this kind are used, for example, in diesel fuel injection systems, where they are subjected to very high temperatures. When diesel engines, namely those provided with a direct injection, are operated for motor braking, very high temperatures can be produced in the diesel fuel injectors, by means of which they can be "soft annealed" and as a result, can become unsuitable for further operation (wear, risk of fracture).

With the use of this type of fuel injectors in gasoline engines provided with direct injection systems, in addition to wear, problems also arise as a result of corrosion of the fuel injectors.

An object of the invention, therefore, is to improve a fuel injector of this generic type to such an extent that on the one hand, the fuel injector can be used at very high temperatures, wherein in particular, the soft annealing mentioned above in connection with diesel engines should be prevented, and that on the other hand, the improved fuel injector has a high degree of corrosion resistance so that it is also possible to use the fuel injector in gasoline direct injection systems. It should be possible to manufacture the fuel injector as simply and therefore inexpensively as possible.

ADVANTAGES OF THE INVENTION

This object is attained according to the invention with fuel injector of the type described at the beginning by virtue of the fact that the nozzle body is comprised of a rustproof martensitic steel, which is hardened by means of case hardening with nitrogen.

The improvement of the corrosion resistance of martensitic rustproof steels by means of case hardening with nitrogen is drawn, for example, from DE 40 33 706 A1. In the heat treating process disclosed by this reference, the main idea is to increase the corrosion resistance.

Based on a large number of trials, it has turned out that the heat treating process drawn from DE 40 33 706 A1 surprisingly can also be used to increase the temperature resistance of nozzle bodies. In particular, it has turned out that the above-described soft annealing of the nozzle body at high temperatures can be avoided through the use of a martensitic rustproof steel which has been hardened by means of case hardening with nitrogen.

It is particularly advantageous in this connection that the injection openings are also hardened.

Steels with the following composition can advantageously be considered as rustproof martensitic steels: <0.1, preferably 0.01 weight % C; from 0.03 to 0.3, preferably 0.1 weight % N; from 0.01 to 1.0, preferably 0.06 weight % Si; from 10.0 to 20.0 preferably 13.7 weight % Cr; <5.0, preferably 1.5 weight % Mo; <0.5, preferably 0 weight % Nb; <0.5, preferably 0.1 weight % V, and alloy additives for the suppression of δ-ferrite.

In order to suppress the δ-ferrite formation, preferably alloy additives of the following composition are added: from 0.01 to 1.0, preferably 0.03 weight % Mn; <5.0, preferably 2.2 weight % Ni; <5.0, preferably 2.7 weight % Co.

Up to now, no further information has been given with regard to the case hardening.

The nozzle body is advantageously hardened by means of case hardening at a temperature of 1050 to 1200° C., preferably 1100° C., at a pressure of 0.5 to 10 bar, preferably at 3 bar, over a time period of 1 h to 30 h, preferably 4 h.

Through such an embodiment of the nozzle body out of rustproof martensitic steel, which is hardened by means of case hardening with nitrogen as described above, not only are the corrosion and wear resistance significantly increased, but the retention of hardness and the red hardness are significantly increased as well.

The advantages in so doing are as follows: there is an improved ease of machining of the unhardened initial material. The boundary layer hardening takes place with a higher degree of manufacturing reliability, which leads to a more uniform surface hardness and hardness penetration, particularly also in the bores that constitute the injection openings, without the occurrence of cleaning problems. Based on a simple manufacture, the fuel injectors can be manufactured not only in a technically simple manner, but also in a particularly inexpensive manner, wherein no distinction has to be drawn between fuel injectors for diesel injection systems and fuel injectors for gasoline injection systems.

BRIEF DESCRIPTION OF THE DRAWING

Other features and advantages of the invention are the subject of both the description below and the graphic depiction of an exemplary embodiment.

The sole FIGURE schematically depicts a longitudinal section through the injection-side end section of an exemplary embodiment of a fuel injector.

DESCRIPTION OF THE EXEMPLARY EMBODIMENTS

The invention is explained schematically below in conjunction with a fuel injector for a diesel engine. It goes without saying that the invention is not limited to fuel injectors for diesel engines, but also, extends to fuel injectors for gasoline direct injection systems.

The fuel injector depicted in the sole FIGURE has a nozzle body 10 in which a valve needle 20 is movably supported. On its bottom end, the valve needle 20 has a conical sealing face 22, which comes into contact with a valve seat face 12 that is adapted to it and is therefore conical. The valve seat face 12 is formed on an inner wall region 31 of an end cup 30 of the nozzle body 10. A number of injection openings 32 lead from the valve seat face 12 and pass through the wall of the end cup 30 at an angle to the nozzle axis.

In carrying out the invention both the inner wall region 31, the valve seat face and an outer wall region of the nozzle body 10 are hardened with the use of nitrogen.

Between the valve needle 20 and a cylindrical inner wall of the nozzle body 10, an annular chamber 13 is formed, in which fuel is fed into the annular chamber by a fuel supply line that is not shown. The valve needle 20 is pressed against the valve seat face 12 by a valve spring that is likewise not shown. When the fuel pressure in the annular chamber 13 has increased to a predetermined value, the needle 20 is lifted up counter to the force of the valve spring and the fuel is injected out through the injection openings 32. As shown in the sole FIGURE, the cone angle of the sealing face 22 on the valve needle 20 can be chosen as slightly greater than the angle of the valve seat face 12 so that at the beginning, the highest sealing pressure is produced at the upper edge 24 of the sealing face 22.

In fuel injectors for gasoline direction injection systems, the sealing face 22 can also be ball-shaped and both the valve seat face and the end cup 30 can be embodied in the shape of hollow balls.

Furthermore, the injection openings 32 can also be embodied below the sealing face 22 in the end cup 30.

The fuel injector is put under a great deal of stress during operation. This high degree of stress results on the one hand from the fact that due to constant opening and closing of the fuel injector, the valve needle 20 strikes against the valve seat face 12 continuously, and on the other hand, this high degree of stress also results from the fact that the entire fuel injector is subjected to a very high temperature, for example in a thrust operation of a vehicle that is operated with a diesel engine, in which the motor braking action is used.

When the fuel injector is used in gasoline direct injection systems, corrosion of the fuel injector can occur so that its reliable function cannot be assured.

For this reason, the fuel injector is comprised of a rustproof martensitic steel, for example of the following composition: 0.01 weight % C; 0.1 weight % N; 0.06 weight % Si; 13.7 weight % Cr; 1.5 weight % Mo; 0.1 weight % V, and alloy additives for the suppression of δ-ferrite of the following composition: 0.03 weight % Mn; 2.2 weight % Ni; 2.7 weight % Co, which is hardened by means of case hardening with nitrogen.

The case hardening with nitrogen is preferably carried out at a temperature of 1100° C. and a pressure of 3 bar over a time period of 4 h.

The use of a rustproof martensitic steel that is hardened in this manner on the one hand prevents the fuel injector from becoming soft annealed and therefore unsuitable when it is subjected to very high temperatures, which would cause a risk of fracturing or an increased wear, and on the other hand, a very favorable corrosion resistance is additionally produced so that the fuel injector can be used in direct diesel injecting systems as well as direct gasoline injecting systems.

The foregoing relates to a preferred exemplary embodiment of the invention, it being understood that other variants and embodiments thereof are possible within the spirit and scope of the invention, the latter being defined by the appended claims.

What is claimed is:

1. A fuel injector for internal combustion engines, comprising a nozzle body (10) in which a valve needle (20) with a sealing face (22) is movably supported, said valve needle comes into contact with a valve seat face (12) that is formed on an inner wall region (31) of an end cup (30) of the nozzle body (10) and adapted to the valve needle, at least one injection opening (32) is provided in said valve seat face, wherein both the inner wall region (31) with the valve seat face (12) of the nozzle body (10) and an outer wall region are hardened, and the nozzle body (10) is comprised of a rustproof martensitic steel that is hardened by means of case hardening with nitrogen, and the rustproof martensitic steel comprises the following composition: from about 0.001 to about 0.10 weight % C; from about 0.03 to about 0.3 weight % N: from about 0.01 to about 1.0 weight % Si; from about 10.0 to about 20.0 weight % Cr; from about 1.0 to about 5.0 weight % Mo; from 0 to about 0.5 weight % Nb; from about 0.01 to about 0.5 weight % V, and alloy additives for a suppression of δ-ferrite.

2. The fuel injector according to claim 1, in which the injection openings (32) are hardened.

3. The fuel injector according to claim 1, in which in order to suppress the δ-ferrite formation, the steel includes alloy additives added to the composition of the following composition: from about 0.01 to about 1.0 weight % Mn; from about 1.0 to about 5.0 weight % Ni; and from about 1.5 to about 5.0 weight % Co.

4. The fuel injector according to claim 1, in which the nozzle body (10) is hardened by means of case hardening at a temperature of 1050 to 1200° C., at a pressure of 0.5 to 10 bar, over a time period of 1 h to 30 h.

5. The fuel injector according to claim 1, in which the nozzle body (10) is hardened by means of case hardening at a temperature of about 1100° C., at a pressure of about 3 bar, over a time period of 4 h.

6. The fuel injector according to claim 1, in which the rustproof martensitic steel has the following composition: about 0.10 weight % C; about 0.1 weight % N; about 0.06 weight % Si; about 13.7 weight % Cr; about 1.5 weight % Mo; 0 weight % Nb; about 0.1 weight % V, and alloy additives for a suppression of δ-ferrite.

7. The fuel injector according to claim 2, in which the nozzle body (10) is hardened by means of case hardening at a temperature of 1050 to 1200° C., at a pressure of 0.5 to 10 bar, over a time period of 1 h to 30 h.

8. The fuel injector according to claim 2, in which the nozzle body (10) is hardened by means of case hardening at a temperature of about 1100° C., at a pressure of about 3 bar, over a time period of about 4 hours.

9. The fuel injector according to claim 2, in which the rustproof martensitic steel has the following composition: about 0.01 weight % C; about 0.1 weight % N; about 0.06 weight % Si; about 13.7 weight % Cr; about 1.5 weight % Mo; about 0.1 weight % V, and alloy additives for a suppression of δ-ferrite.

10. The fuel injector according to claim 9, in which in order to suppress the δ-ferrite formation, the steel has alloy additives added of the following composition: about 0.03 weight % Mn; about 2.2 weight % Ni; and about 2.7 weight % Co.

11. The fuel injector according to claim 9, in which the nozzle body (10) is hardened by means of case hardening at a temperature from about 1050 to about 1200° C., at a pressure from about 0.5 to about 10 bar, over a time period of about 1 h to about 30 h.

12. The fuel injector according to claim 10, in which the nozzle body (10) is hardened by means of case hardening at a temperature from about 1050 to 1200° C., at a pressure from about 0.5 to about 10 bar, over a time period of about 1 h to about 30 h.

13. The fuel injector according to claim 3, in which the nozzle body (10) is hardened by means of case hardening at a temperature of 1050 to 1200° C., at a pressure of 0.5 to 10 bar, over a time period of 1 h to 30 h.

14. The fuel injector according to claim 6, in which the nozzle body (10) is hardened by means of case hardening at a temperature from about 1050 to about 1200° C., at a pressure from about 0.5 to about 10 bar, over a time period of about 1 h to about 30 h.

15. The fuel injector according to claim 6, in which in order to suppress the δ-ferrite formation, the steel includes alloy additives added of the following composition: about 0.3 weight % Mn; about 2.2 weight % Ni; and about 2.7 weight % Co.

16. The fuel injector according to claim 15, in which the nozzle body (10) is hardened by means of case hardening at a temperature from about 1050 to about 1200° C., at a pressure from about 0.5 to about 10 bar, over a time period of about 1 h to about 30 h.

* * * * *